United States Patent [19]

Berthelsen

[11] Patent Number: 4,618,993

[45] Date of Patent: Oct. 21, 1986

[54] VALVE BAG

[75] Inventor: Ernst R. Berthelsen, Terndrup, Denmark

[73] Assignee: Dac-Emballage A.M.B.A., Denmark

[21] Appl. No.: 490,018

[22] Filed: Apr. 29, 1983

[51] Int. Cl.[4] ..... B65D 30/24

[52] U.S. Cl. ..... 383/44; 141/114; 493/213; 493/68

[58] Field of Search ..... 141/10, 67, 68, 114, 141/313–317; 493/213; 383/44; 53/459, 571, 384

[56] References Cited

U.S. PATENT DOCUMENTS 4,036,116 7/1977 Tetenborg et al. ..... 93/32

*Primary Examiner*—Houston S. Bell, Jr.

*Attorney, Agent, or Firm*—Hall, Myers & Rose

[57] ABSTRACT

A valve bag having an upper bottom with a valve and a lower bottom symmetrically folded in a manner where the bottoms lie atop the central bag portion in a side-by-side and parallel manner is provided.

5 Claims, 11 Drawing Figures

VALVE BAG

TECHNICAL FIELD

This invention relates to valve bags. More particularly, this invention relates to a valve bag and its use, the bag having an upper bottom and a lower bottom, the upper bottom having a filling valve therein and the bag being symmetrically folded where both bottoms face upwardly.

BACKGROUND OF THE INVENTION

The art of automated mounting and filling valve bags generally involves sequentially lifting an individual bag from the top of a stack of bags with a bill which is first inserted into the valve located in one of the bag bottoms. After insertion of the bill, a gripping means grips the opened valve around the bill, whereupon the bill is retracted. As the gripper maintains the valve in an opened position, the gripper device moves the bag to a material filling spout and positions the valve on the spout for filling. Subsequently the gripper opens leaving the bag on the spout and moves to repeat the procedure with another bag.

When being moved from the stack to the filling spout, conventional valve bags so employed, often shift relative to the gripper, thereby causing the valve to become misaligned with the spout. This displacement is attributable to inertial forces generated upon swinging the bag from the stack to the spout. Due to the configuration of a conventional bag, the gripper secures only the upper bag bottom containing the valve. Thus upon removal from the stack, the lower bag bottom freely hangs from the gripper. During fast movements, the inertial forces of the freely hanging, lower bottom result in displacement of the upper bottom relative to the gripper and, therefore, misalignment.

One solution to overcome this problem, is to associate properly placed suction devices with the gripper. Such devices, if designed to overcome the inertial forces, secure the relative position of the gripper and the bag, thereby eliminating the displacement problem. However, suction devices overly complicate the structure of the gripper device. Furthermore, in use, suction devices present considerable maintenance problems due to the particle filled environment associated with a conventional filling apparatus.

Turning to the manufacture of valve bags, generally, caution is exercised during the crimping or folding processes. Conventional adhesives employed to glue the bottoms, in practice, are not fully cured during folding operations. Because folding apparatus generally employs opposed, cooperating rollers or belts for folding, the folds are located at some distance relative to the freshly glued bottoms. If folding occurs along a line where the glued portions are pressed by the rollers or belts, the uncured adhesive is squeezed out from its original line of application and the bag quality is correspondingly diminished. Therefore, such folds are produced along lines avoiding contact between the glued bottoms and the rollers.

SUMMARY OF THE INVENTION

Accordingly, it is an object of the present invention to provide a valve bag associated methods and apparatus therefor which overcome the aforementioned problems.

It is another object of this invention to provide a novel valve bag facilitating filling operations without disruption due to misalignment.

Still a further object of this invention is to provide folded, stacked valve bags of compact dimensions to facilitate stacking and support arrangements therefor.

Yet another object of this invention is to provide a maximum number of bags on a supporting pallet.

Another object of this invention is to provide a means for making folds in bags where folds are located near the bag bottoms and the means prevents contact between the bottoms and the folding means.

These and other objects are satisfied by providing a valve bag having an upper bottom incorporating a valve, a lower bottom, and a central portion extending therebetween and two opposite parallel folds in said central portion where the bottoms rest side-by-side on said central portion in a symmetrical manner. More particularly, the symmetrical folding arrangement results in the positioning of the bag bottoms in close proximity to each other in a parallel and side-by-side relationship thereby permitting both bottoms to be supported simultaneously during lifting of the bag from a stack. By supporting and lifting both bottoms simultaneously, the hanging or pendant central portion of the bag generates a much smaller inertial force than that generally associated with valve bags. Thus, displacement of the valve relative to the gripper is minimized.

In the context of an automated filling system, this invention provides the additional benefit of movement of empty valve bags to a plurality filling spouts to maximize filling capacity.

The invention will become apparent to the skilled artisan reviewing the following, illustrative, detailed description of the preferred embodiment.

DETAILED DESCRIPTION OF THE PREFERRED EMBODIMENTS

Figure 1:
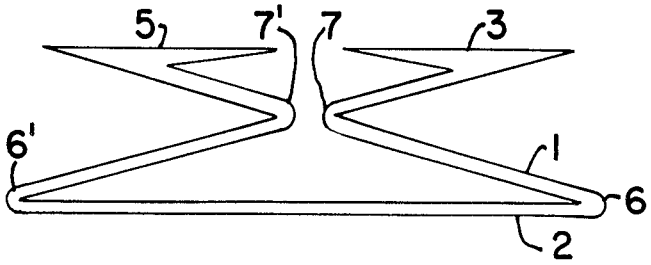
FIG. 1 is a cross-sectional view of a distorted valve bag according to this invention.
Figure 2:
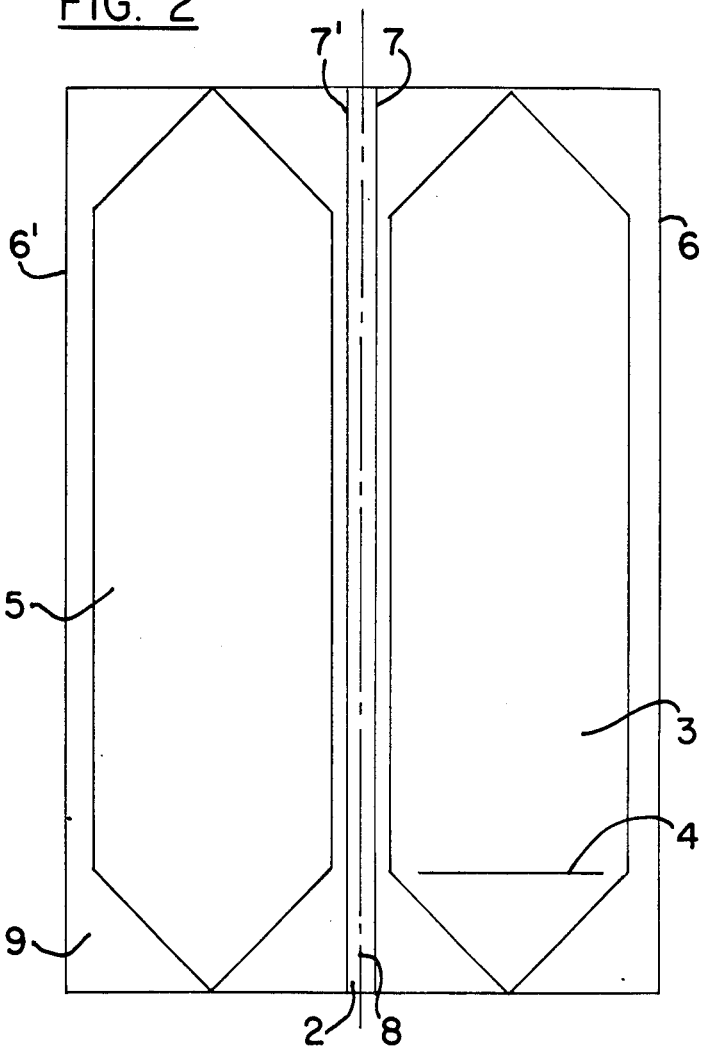
FIG. 2 is a top view of the bag.

FIGS. 1 and 2 illustrate folded valve bag 1 according to the invention. Valve bag 1 comprises a tube-shaped, flat central portion 2, upper bottom 3 with filling valve 4 and lower bottom 5. Bottoms 3 and 5 are folded in such a way that they lie in a single plane, parallel to and above central portion 2. Central portion 2, which normally has a length about six times the width of the bottoms, is provided with folds 6,6' and 7,7' of which folds 6,7 are symmetrical with and correspond to folds 6',7'. The distance between folds 6 and 6' is somewhat greater than the double width of bottoms 3 and 5, and the distance between folds 6 and 7 and between 6' and 7' is a little less than the distance from centerline 8 of bag 1 and folds 6 or 6'. As illustrated, the two sets of folds 6 and 6', and 7 and 7' are made in opposite directions. Thus, folded bag 1 features the two bottoms 3 and 5 lying on central portion 2 separated only a small distance. Moreover, bottoms 3 and 5 lie completely within the peripheral outline of folded bag defined by central portion 2.

Folded bottoms 3 and 5 form elongated hexagons thus providing triangular areas 9 at each corner of bag 1. This configuration permits bottoms 3 and 5 to be lifted, using folds 7,7' as a hinge. The arrangement of the folds 7,7' allows a lifting of the bottoms using the folds 7,7' as a fulcrum, corresponding substantially to the centerline 8 of the bag. This is an important feature of the bag according to the invention when it is to be used in an applicator for applying bags on the spouts of a filling apparatus. The importance of this feature is underscored in FIGS. 3 and 4.

Figure 3:
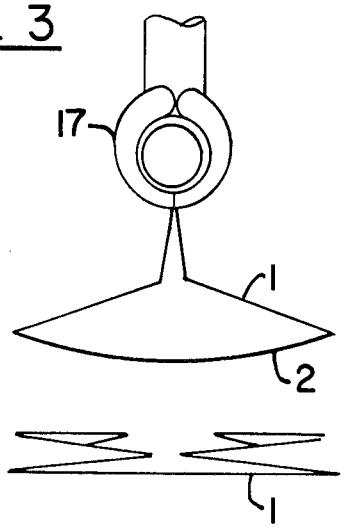
FIG. 3 illustrates the bag as it is gripped.
Figure 4:
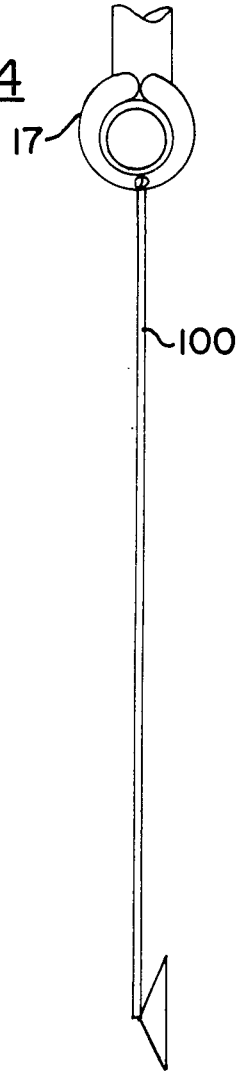
FIG. 4 represents a prior art bag being gripped.

As illustrated in FIG. 4, a prior art bag 100 is lifted from a pile by gripper 17. After having been lifted the bag 100 hangs down from the gripper thus permitting development of a considerable moment of inertia upon movement. The moment of inertia may well lead to displacement of bag 100 relative to gripper 17. FIG. 3 depicts the cross-sectional configuration of bag 1 with gripper 17. Bag 1 is lifted from a stack of bags in a manner where both bottoms 3 and 5 are gripped by gripper 17. Thus, the moment of inertia of bag 1 generated by movement of bag 1 hanging down from gripper 17 is reduced because only central portion 2 freely hangs from gripper 17. Furthermore, the force necessary to separate bag 1 from the stack is reduced.

Figure 5:
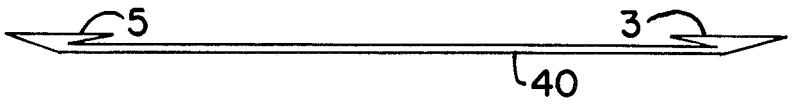
FIGS. 5–11 diagrammatically represent the marking and folding processes to produce the valve bags.
Figure 6:
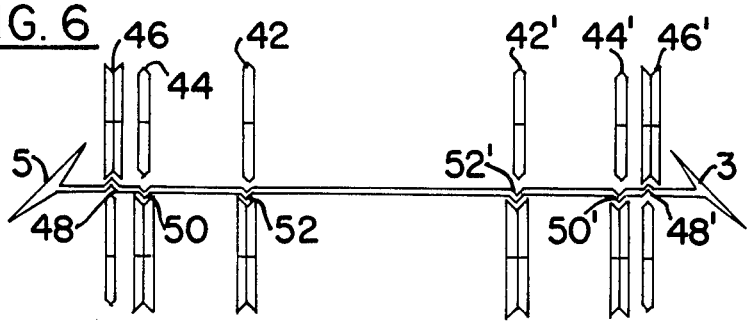
Figure 7:
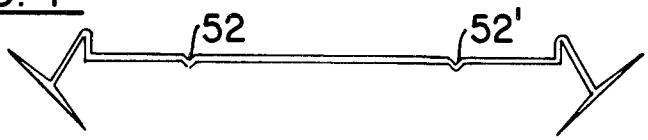
Figure 8:
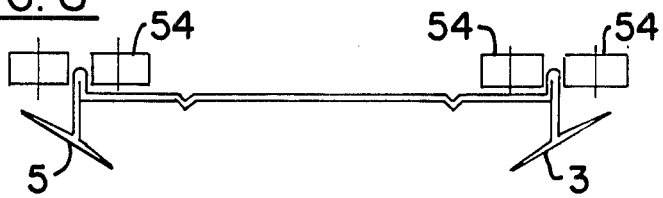

Now that the valve bag contemplated by this invention has been sufficiently described, the bag folding process is now disclosed. The folding of the bags is accomplished by the method illustrated in FIGS. 5–11. Valve bag blank 40 is delivered in a flat configuration from a conventional bottom forming machine, illustrated in FIG. 5. With bottoms 3 and 5 facing downwards, bag 40 is conveyed through three sets of coacting, oppositely grooved, wheels and counterwheels 42,44,46 and 42',44'46'. Each wheel set comprises a circumferentially pointed wheel and circumferentially, matched grooved wheel designed to mark blank 40 with a crease oriented in a particular direction. When bag blank 40 is conveyed between the wheels forming creases 48,50 and 52 and corresponding creases 48',50' and 52'. These creases indicate folding lines for exact and sharp folding of bag blank 1.

Coacting grooved wheel sets 42,42' and 44,44' crease blank 40 with downwardly pointing creases 52,52' and 50,50', respectively while wheel sets 46 and 46' generate upwardly oriented creases 48 and 48'. After so marking bag blank 40, it is carried by a conveyor to a set of folding irons. Thereafter, the bag is conveyed through a set of pressing wheels 54 rotating about vertically disposed axles resulting in the formation of folds 7 and 7'. This arrangement prevents bottoms 3 and 5 from being squeezed between the wheels, which could lead to an uneven pressing and squeezing out of some of the still uncured adhesive from bottoms 3 and 5 of bag blank 40.

Figure 11:
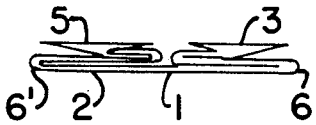
Figure 9:
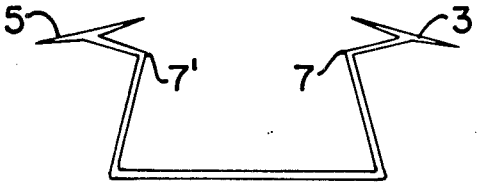
Figure 10:
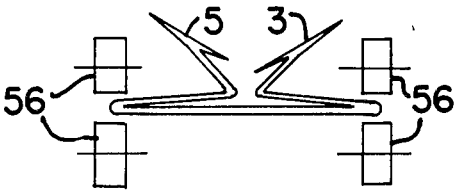

Subsequent steps include folding the ends of the bag along creases 52 and 52' as shown in FIG. 9. Creases 52 and 52' are pressed between a further set of pressing wheels 56 (see FIG. 10) whereby the two last folds, corresponding to folds 6 and 6', are formed. FIG. 11 illustrates finished bag 1 processed from blank 40 which is ready to be stacked. An additional benefit from the configuration of bag 1 is formation of stable stacks. Stack stability is realized as all foldings are symmetrical and as the bag has substantially the same number of layers over the entire folded area.

Those modifications and variations of the preferred embodiment which should now be apparent to the skilled artisan, are intended to fall within the scope of the invention as defined by the following claims:

I claim:

1. A valve bag, comprising;

(a) a substantially flat upper bottom, including a valve adapted for insertion of a filling spout, (b) a substantially flat lower bottom, (c) an elongated central portion disposed between said upper and lower bottom, said central portion including a first and second sets of fold lines, said fold lines being perpendicular to the direction of elongation of the central portion, each of said first set of fold lines being disposed between the center line of the central portion and the bottoms and each of the second set of fold lines being disposed between the first lines and the bag bottoms, (d) where the bag is symmetrically folded along the first and second fold lines so that the upper and lower bottoms lie on the central portion in a side-by-side and parallel manner.

2. A bag according to claim 4 where said bottoms are hexagonally shaped thereby exposing a section of the central portion next to said bottoms.

3. A valve bag, comprising:

(a) a first and a second bottom, said first bottom including a slotted valve, said first and second bottoms substantially similarly dimensioned, (b) a central portion capable defining a hollow cavity therein, each end of said portion being connected to and continuous with one each of said bottoms, (c) a first set of fold lines parallel to said first and second bottoms and disposed between said bottoms and the transverse center line of said central portion, (d) a second set of fold lines each being parallel to said first set of fold lines and disposed between one of said first set of fold lines and one of said bottoms, (e) where said bottoms are foldable onto said central portion and alignable in a parallel fashion.

4. A valve bag according to claim 3 where said central portion is elongated and said bottoms are substantially flat where said bottoms and central portion are in a relatively flat configuration when folded.

5. A valve bag according to claim 4 where said bottoms are symetrically folded on said central portion and are dimensioned so as to expose at least a peripheral portion of said central portion when folded and lying thereon.

* * * * *